United States Patent [19]

Nakano

[11] Patent Number: 4,563,986

[45] Date of Patent: Jan. 14, 1986

[54] SPLASH LUBRICATED OVER HEAD VALVE ENGINE

[75] Inventor: Keiichi Nakano, Sakaishi, Japan

[73] Assignee: Kubota Ltd., Osaka, Japan

[21] Appl. No.: 646,143

[22] Filed: Aug. 31, 1984

[30] Foreign Application Priority Data

Sep. 9, 1983 [JP] Japan ..... 58-140575[U]

[51] Int. Cl.[4] ..... F01M 9/10

[52] U.S. Cl. ..... 123/90.38; 123/196 M; 123/572

[58] Field of Search ..... 123/196 M, 196 R, 90.33, 123/90.37, 90.38, 572, 574; 184/11.1, 13.1

[56] References Cited

U.S. PATENT DOCUMENTS

| | | | |
|---|---|---|---|
| 3,469,565 | 9/1969 | Weber et al. | 123/574 |
| 3,908,617 | 9/1975 | Partridge | 123/572 |
| 4,404,936 | 9/1983 | Tatebe et al. | 123/196 R |
| 4,501,234 | 2/1985 | Toki et al. | 123/196 R |

*Primary Examiner*—E. Rollins Cross

*Attorney, Agent, or Firm*—Schwartz, Jeffery, Schwaab, Mack, Blumenthal & Evans

[57] ABSTRACT

A splash lubricated over head valve engine provided with a gas inducing and a oil return passages both communicate the crank room and the rocker arm chamber, and with a breather disposed inside the rocker arm cover, wherein: the outlet opening of the gas inducing passage and inlet opening of the breather are disposed at opposite end portions of the rocker arm chamber, so as to make the flow of blow-by gas in the rocker arm chamber traverse across the rocker arms aslant.

7 Claims, 3 Drawing Figures

SPLASH LUBRICATED OVER HEAD VALVE ENGINE

BACKGROUND OF THE INVENTION

1. Field of the Invention

The present invention is related to a splash lubricated over head valve engine which is improved to minimize overall height of the engine and to obtain better lubrication of valve driving members such as rocker arms.

The engine according to the present invention is provided with the premise structure; i.e., as shown in the drawings 1 and 2, the splash lubricated over head valve engine according to the present invention is provided with a gas induction passage 4 and an oil return passage 5 both of which communicate a crank room 1 with a rocker arm chamber 3 in a head cover 2 in parallel. The head cover 2 is provided with a breather 6 which inlet 7 is communicated with the rocker arm chamber 3.

2. Description of the Prior Art

In the splash lubricated over head valve engine of the known type, lubricant is fed by means of reciprocation of push rods from the crank room to the rocker arm chamber. In this manner, the strength of feeding pressure is determined by the stroke of the push rods. Therefore, it is impossible to obtain sufficiently high feeding pressure. Moreover, the limitation in the location of the opening for spout in the rocker arm chamber results in the difficulty of the sure feeding of the lubricant to the moving parts of the valve drive mechanism.

In order to avoid these problems, a breather, which serves to dispose of blow-by gas leaked from the combustion chamber to the crankroom, is disposed in the space specially provided on the rocker arm chamber so as to induce blow-by gas into the rocker arm chamber for the separation of the oil therefrom. However, in this known manner, the breather is extruded over the head cover, so that the overall height of the engine is tall disadvantageously.

SUMMARY OF THE INVENTION

The present invention is aimed at dissolving these problems, obtaining better lubrication of the parts such as rocker arms still the overall height of the engine is kept small.

In order to attain the objects above mentioned, the present invention, shown in FIG. 1–3, is comprised as follows: A rocker arm chamber 3 is set on the push rod 8 side of the cylinder head 17 and inclined to the push rod 8 side, and a breather 6 is disposed in the upper half end portion of the push rod 8 side of the rocker arm chamber 3.

And an outlet opening 12 of a gas inducing passage 4 is opened at one side portion P of the end surface on the inlet and outlet valves 10 and 11 side of the rocker arm chamber 3, and an inlet opening 7 of the breather 6 at the opposite side portion Q of the end surface on the push rod 8 side of the rocker arm chamber 3, so as to make the center line S of the blow-by gas flow, which is extended from the outlet opening 12 of the gas inducing passage 4 to the inlet opening 7 of the breather 6 through the rocker arm chamber 3, tranversing across both rocker arms 14 aslant.

Therefore, the blow-by gas spouted from the outlet opening 12 of the gas inducing passage 4 traverses through the rocker arm chamber 3 aslant, separating oils to lubricate both rocker arms 14.

Then, the separated oils are returned to oil pan 27 through the oil return passage 5, and the gas component of the blow-by gas is exhausted from the breather 6 after the oils are finely separated in the breather 6.

Thus, the present invention brings out the following advantages.

The oil involved in the blow-by gas adheres to the rocker arms and stems of the inlet and outlet valves to lubricate them more preferably while it traverses across both rocker arms aslant toward the breather. Moreover, the length of the flow is elongated so long that a sufficient amount of oils adheres for lubrication, since the flow traverses the rocker arm chamber aslant.

As the breather is disposed in the upper half space on the end portion of push rod side in the inclined rocker arm chamber, in a sense, it makes a dead space, which occupies the slant upper empty portion in the rocker arm chamber, useful without extruding in the special space above the chamber. Thus, the engine is compact and of a small height.

The present invention will be more readily understood by reading the following detailed description of the preferred embodiments shown in the attached drawings.

BRIEF DESCRIPTION OF THE DRAWINGS

In the drawings showing a preferred embodiment of the present invention.

DETAILED DESCRIPTION OF THE PREFERRED EMBODIMENTS

Figure 1:
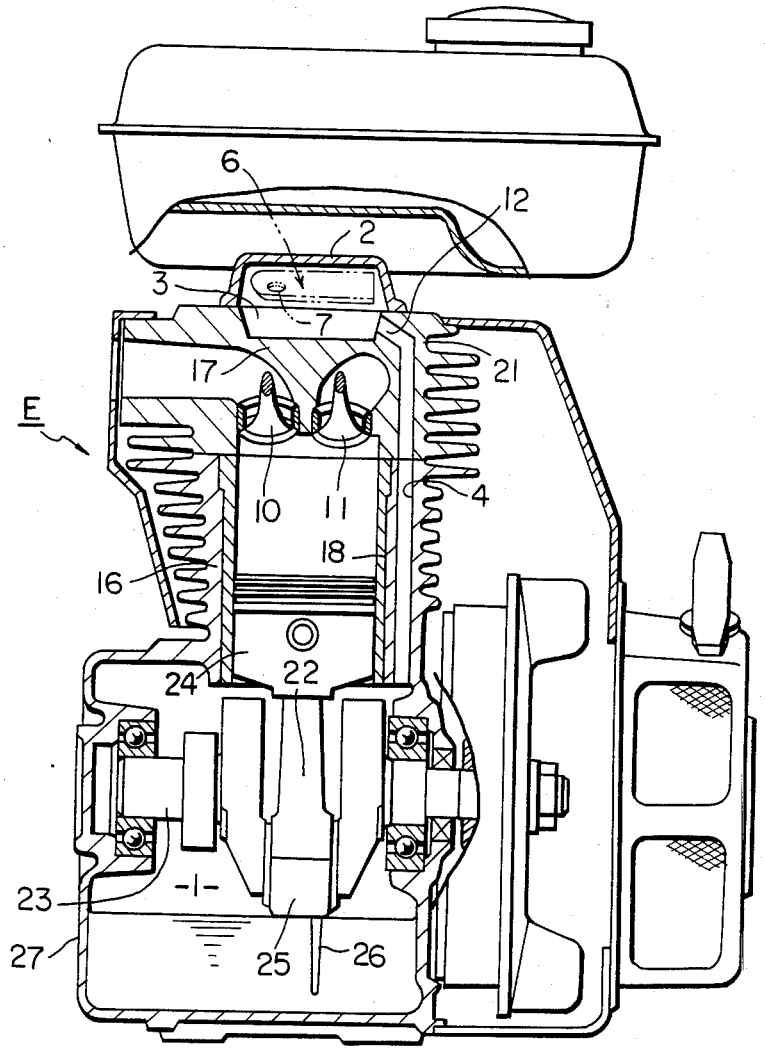
FIG. 1 is a vertical sectional side view of the engine according to the preferred embodiment of the present invention.
Figure 2:
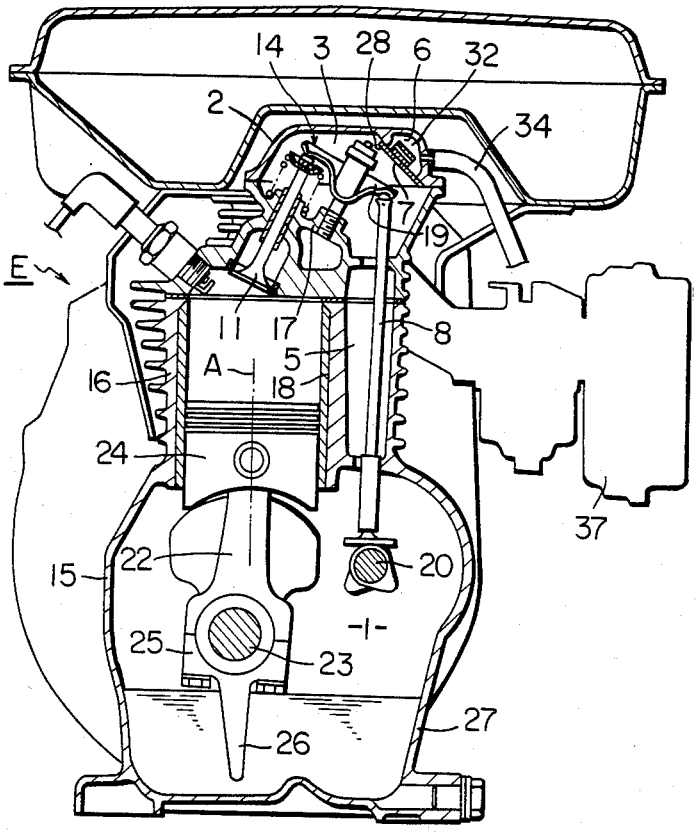
FIG. 2 is a vertical sectional front view of the engine according to the preferred embodiment of the pre-present invention.
Figure 3:
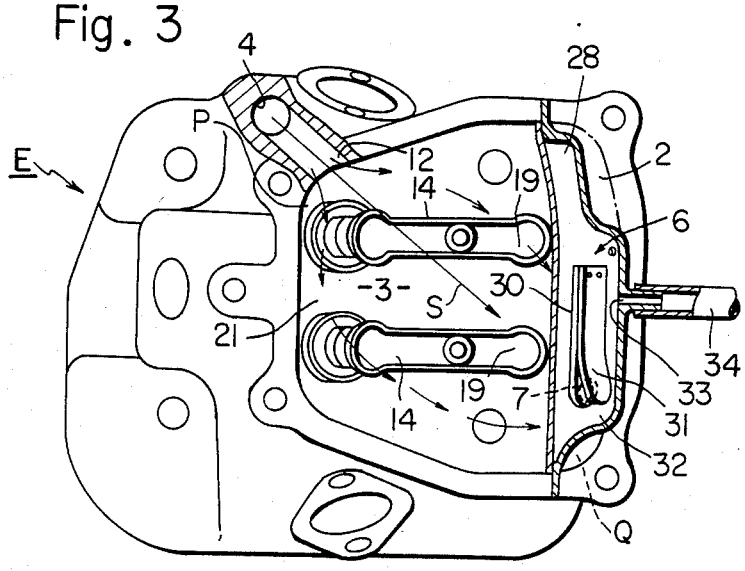
FIG. 3 is a partially sectioned plane view of the portion around the cylinder head of the engine according to the preferred embodiment of the present invention.

In the figures, the engine E acording to a preferred embodiment is provided with a crank case 15, a cylinder block 16 made in a body with the crank case 15, a cylinder head 17 is fixed on the cylinder block 16, an inlet and an outlet valves 10 and 11 both disposed aslant with respect to the axis A of the cylinder 18, and rocker arms 14 associated with a cam 20, which is disposed in the crank room 1 in the crank case 15, at the power intake arm end 19 by means of push rods 8.

The rocker arm chamber 3 is defined by a head cover 2 fixed on the cylinder head 17 to cover the rocker arms 14 from the upper side, and the top surface 21 of the cylinder head 17, in the shape inclined lower toward the push rod 8 side.

The cylinder 18 located in the center of the cylinder block 16 contains a piston 24 which slides up and down by means of the connection with the crank shaft 23 through the connecting rod 22.

A spoon 26 for splashing the oil is provided at the big end 25 of the connecting rod 22, so as to stir the oil reserved in the oil pan 27 located below the crank case 15 for the realization of the splash lubrication of the over head valve engine.

Besides, a gas inducing passage 4 is passed through in the front side of the cylinder block 16, and a passage 5 for push rods 8 passing through the left side of the cylinder block 16 is serving as an oil return passage 5 which communicates the rocker arm chamber 3 and the crank room 1 parallel with the gas inducing passage 4.

The outlet opening 12 of the gas inducing passage 4 is opened at the portion P set aside to one of the valves 10 or 11, i.e., at the upper portion of the inclined rocker arm chamber 3, while a breather 6 is located in the upper half space above the end portion of push rod side of the rocker arm chamber 3.

The breather 6 comprises a partition 28 which closes the upper half space above mentioned, and a lead valve 30, and an inlet opening 7 is opened through the partition 28 at the side Q which is faced to the push rods 8, moreover, the outlet opening 12 of the gas inducing passage 4 directed to this inlet opening 7, so as to guide blow-by gas toward the breather 6.

Therefore, the center line S of blow-by gas is directed aslant with respect to a pair of rocker arms 14.

The lead valve 30 and valve stopper plate 31 are put to capably open and shut on the back surface of the partition 28, and the breather chamber 32 is defined by the head cover 2 and the partition 28. The exhaust port 33 is provided at the part of side wall of the head cover 2, which part defines the breather chamber 32, and conduit pipe 33 is communicated to the port 33 for release of blow-by gas into the atom sphere or return of it to clean air chamber of an air cleaner 37.

According to the splash lubricated over head valve engine E mentioned above, the oil is fiercely stirred by the spoon 26 connected to the connecting rod 22, and misted to fill in the crank case 15, and the blow-by gas blown from the combustion chamber to the crank room 1 involves the oil mist and rises up to the rocker arm chamber 3 through the gas inducing passage 4.

The blow-by gas raised into the rocker arm chamber 3 traverses from the outlet opening 12 of the gas inducing passage 4 toward the inlet opening 7 of the breather 6 alsant with respect to the rocker arms 14, and during the traversing, oil adheres to the parts of valve driving mechanism such as rocker arms 14 to lubricate them more preferably.

Then, the gas component of the blow-by gas introduced into the breather 6 is selectively exhausted through the conduit pipe 34 after the oil involved therein is finely separated by the breather 6.

In such a manner, the present invention is adopted to the splash lubricated over head valve engine to realize more effective and more sufficient lubrication of the parts in the head cover.

What is claimed is:

1. A splash lubricated over head valve engine comprising:

a cylinder having a cylinder head;

a rocker chamber, having a plurality of rocker arms therein, disposed on a first side of said cylinder head, said rocker chamber inclined lower toward said first side of said cylinder head;

an inlet valve and an outlet valve disposed on a first side of said rocker chamber;

a crank case;

a breather chamber having an inlet means, said breather chamber connected to said rocker chamber via said inlet means, said breather chamber disposed above a second side of said rocker chamber;

a gas inducing passage having an outlet means;

an oil return passage substantially parallel to said gas inducing passage, said gas inducing passage and said oil return passage connecting said rocker chamber and said crank case;

wherein said outlet means of said gas inducing passage is opened at one side portion of an end surface on said first side of said rocker chamber; and wherein said inlet means of said breather chamber is opened at an opposite side portion of an end surface on said second side of said rocker chamber, such that blow-by gas flows along a line extended from said outlet means through said rocker chamber to said inlet means, traversing said rocker arms.

2. The splash lubricated overhead valve engine of claim 1, wherein said first side of said rocker chamber is opposite said second side.

3. The splash lubricated over head valve engine of claim 1, wherein at least one push rod means is connected downwardly from said first side of said cylinder head.

4. The splash lubricated over head valve engine of claim 1, further comprising a head cover, said head cover comprising said rocker chamber and said breather chamber.

5. The splash lubricated over head valve engine of claim 1, wherein:

said outlet means of said gas inducing passage is directed to said inlet means of said breather.

6. The splash lubricated over head valve engine of claim 1, wherein:

said oil return passage comprises a passage for push rods.

7. The splash lubricated over head valve engine of claim 1, wherein:

said inlet and outlet valves are inclined toward said first side of said cylinder head.

* * * * *